US009375761B1

(12) United States Patent
Dawson et al.

(10) Patent No.: US 9,375,761 B1
(45) Date of Patent: Jun. 28, 2016

(54) METHODS FOR MODIFYING NON-STANDARD FRAC SAND TO SAND WITH FRACKING PROPERTIES

(71) Applicant: Walker-Dawson Interests, Inc., Praireiville, LA (US)

(72) Inventors: Richard F. Dawson, Clinton, LA (US); Richard Ryan Dawson, Clinton, LA (US)

(73) Assignee: Walker-Dawson Interests, Inc., Prairieville, LA (US)

( * ) Notice: Subject to any disclaimer, the term of this patent is extended or adjusted under 35 U.S.C. 154(b) by 388 days.

(21) Appl. No.: 13/986,647

(22) Filed: May 21, 2013

Related U.S. Application Data

(60) Provisional application No. 61/657,437, filed on Jun. 8, 2012.

(51) Int. Cl.
*B02C 19/00* (2006.01)
*B08B 3/02* (2006.01)

(52) U.S. Cl.
CPC .. *B08B 3/02* (2013.01); *B02C 19/00* (2013.01)

(58) Field of Classification Search
CPC ..... B02C 19/00; B08B 3/02
USPC ..... 241/5, 39, 30, DIG. 10
See application file for complete search history.

(56) References Cited

U.S. PATENT DOCUMENTS

| | | | | |
|---|---|---|---|---|
| 2,766,496 | A | 10/1956 | Ward | |
| 4,268,295 | A | 5/1981 | Yamamoto et al. | |
| 5,035,090 | A | 7/1991 | Szucs | |
| 5,346,141 | A | 9/1994 | Kim et al. | |
| 6,382,321 | B1 * | 5/2002 | Bates et al. | 166/372 |
| 6,527,906 | B1 | 3/2003 | Otter | |
| 6,619,889 | B1 * | 9/2003 | Sinker et al. | 406/92 |
| 6,832,655 | B2 | 12/2004 | Ravensbergen et al. | |
| 7,754,076 | B2 | 7/2010 | Costinel | |
| 2010/0071902 | A1 | 3/2010 | Ziegler | |

FOREIGN PATENT DOCUMENTS

| | | | |
|---|---|---|---|
| GB | 2034606 | A | 6/1980 |
| JP | 2006137624 | A | 6/2006 |

* cited by examiner

*Primary Examiner* — Mark Rosenbaum
(74) *Attorney, Agent, or Firm* — McGlinchey Stafford, PLLC; R. Andrew Patty, II

(57) ABSTRACT

Methods for converting non-standard frac sand into sand with fracking properties using at least one jet pump.

12 Claims, 1 Drawing Sheet
(1 of 1 Drawing Sheet(s) Filed in Color)

METHODS FOR MODIFYING NON-STANDARD FRAC SAND TO SAND WITH FRACKING PROPERTIES

REFERENCE TO RELATED APPLICATIONS

Claim is hereby made to the benefit of the priority of U.S. Provisional Patent Application No. 61/657,437, filed Jun. 8, 2012, the disclosure of which is incorporated herein by reference.

TECHNICAL FIELD

This invention relates to sands with fracking properties and methods for converting non-standard frac sand into sand with fracking properties using at least one jet pump.

BACKGROUND

Sand is a naturally occurring granular material composed of finely divided rock and mineral particles. The composition of sand is highly variable, depending on the local rock sources and conditions. In nature, sand also varies in particle size. Depending on the source, the sand particle size range can vary, e.g. particle diameters as small as 0.02 mm were considered sand under the Albert Atterberg standard in use during the early 20th century. Under the American Association of State Highway and Transportation Officials, the minimum sand diameter size is 0.074 mm, while the United States Department of Agriculture is at 0.05 mm. Sand may be further classified according to grades. ISO 14688 grades sands as fine, medium and coarse with ranges 0.063 mm to 0.2 mm to 0.63 mm to 2.0 mm. In the United States, sand is commonly divided into five sub-categories based on size: very fine sand (1/16–1/8 mm diameter), fine sand (1/8 mm–1/4 mm), medium sand (1/4 mm–1/2 mm), coarse sand (1/2 mm–1 mm), and very coarse sand (1 mm–2 mm).

Sand has been the component of many different applications such as in agriculture; recreational aquariums; geotextile; beach nourishment; brick, cob, concrete, glass, and mortar manufacturing; landscaping; paint texture; railroad traction; sand casting; sandbags; sandblasting; water filtration; and fracking. However, in many industrial applications, before sand can be efficiently utilized, its chemical and/or physical properties must be modified or altered for the intended purpose. For example, sand has been widely used in fracking.

In order to improve fracking, it is highly desirable to employ sand with certain fracking properties. For example, among other properties, the sand used should have the mechanical strength to withstand closure stresses to hold fractures open after the fracturing pressure is withdrawn. Large mesh sands have greater permeability than small mesh sands at low closure stresses, but will mechanically fail (i.e. get crushed) and produce very fine particulates ("fines") at high closure stresses such that smaller-mesh sands overtake large-mesh sands in permeability after a certain threshold stress. Untreated sand is prone to significant fines generation; fines generation is often measured in wt % of initial feed.

Another property desirable for fracking relates to the geometry of the sand. I Certain shapes or forms amplify stress on the sand particles, thus decreasing its strength and making them especially vulnerable to crushing. Thus, sand used in fracking should have ideal sphericity and roundness properties. In addition to the shape of the individual sand particle, it is also desirable to employ sand characteristic of certain cluster and turbidity values.

Though there are known methods in the art to modify sand into sand with fracking properties; these methods often require multiple steps that results in increased cost and time to produce. In addition, the general methods known to modify sand into sand with fracking properties often require the use of non-contaminated sand. Thus, there is a need for a cost and/or time effective method to modify sand into sand with fracking properties. There is also a need for a method that can decontaminate sand, thereby allowing the re-usability of the sand.

SUMMARY OF THE INVENTION

This invention provides a novel method to modify sub-standard frac sand into sand with fracking properties. The terms "modify", "convert", "alter", "transform", "treat" and "change" are used interchangeably with one another and refer to any actions upon sand resulting in any improvement to the property of sand for the purposes of fracking.

In one aspect of the invention, a process for producing standard frac sand is provided comprising: (a) passing sub-standard frac sand at least one time through at least one jet pump under processes and conditions sufficient to remove at least one contaminant from the sub-standard frac sand and/or improve sub-standard frac sand into standard frac sand with at least one of the following frac sand properties: (i) clusters of less than 1.0 percent, (ii) at least 90 percent of the standard frac sand should fall between a designated sieve size, (iii) not more than 0.1 percent of the standard frac sand should be larger than a maximum sieve and not more than 1.0 percent of the standard frac sand should fall through a minimum sieve, (iv) a turbidity value of 250 or less, (v) a sphericity value of 0.6 or greater, and (vi) a roundness value of 0.6 or greater; and (b) recovering the standard frac sand and/or the standard frac sand with the desired properties.

In another aspect of the invention, a process for producing standard frac sand is provided comprising: (a) passing sub-standard frac sand at least one time through at least one jet pump under processes and conditions sufficient to remove at least one contaminant from the sub-standard frac sand and/or improve sub-standard frac sand into standard frac sand with all of the following frac sand properties: (i) clusters of less than 1.0 percent, (ii) at least 90 percent of the standard frac sand should fall between a designated sieve size, (iii) not more than 0.1 percent of the standard frac sand should be larger than a maximum sieve and not more than 1.0 percent of the standard frac sand should fall through a minimum sieve, (iv) a turbidity value of 250 or less, (v) a sphericity value of 0.6 or greater, and (vi) a roundness value of 0.6 or greater; and (b) recovering the standard frac sand and/or the standard frac sand with the desired properties.

As used herein, the term "sub-standard frac sand" refers to any sand that: (i) is found in nature, and not treated by humans, (ii) has been contaminated, (iii) has not been in contact with a jet pump, (iv) does not meet the American Petroleum Institute's ("API") RP-56 specification, or (v) is not suitable for fracking but may be modified to be suitable for fracking.

As used herein, the term "contaminant" refers to any material, substance, or compound which is not sand. Non-limiting examples of contaminants include hydrocarbons such as oil and petroleum; metal particles; dust; pollutants; silts; clay; mud; any chemicals such as those used in fracking, e.g. liquid frac; any byproducts of fracking; and any compound, substance, or material that does not comprise silica or silicon dioxide ($SiO_2$) or considered sand.

As used herein, the term "contaminated" refers to the presence of any contaminant with sand.

As used herein, the term "standard frac sand" refers to sub-standard frac sand or any type of sand that has been modified: (i) to have at least one property with a value range suitable for fracking; (ii) to meet the International Standard ISO 13503-2 Specifications; or (iii) to meet the API RP-56 frac sand specification.

As used herein, the term "frac sand property" refers to the following characteristics of sand: turbidy, cluster or agglomerated grain, grain size or particle size distribution, Krumbein Shape Factors (e.g. sphericity, roundness), bulky density, specific gravity, median particle diameter, acid solubility and crush resistance.

These and other features of this invention will be still further apparent from the ensuing description, drawings, and appended claims.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FURTHER DETAILED DESCRIPTION OF THE INVENTION

Figure 1:
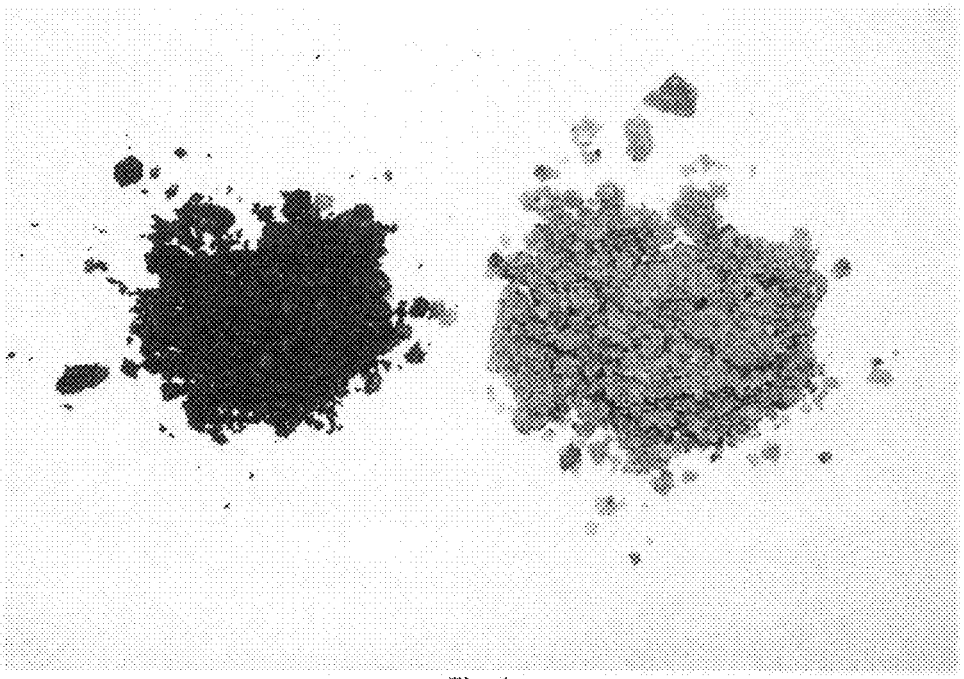
FIG. 1 illustrates the removal of contaminates according to one aspect of the invention.

The present invention provides a novel method for converting sub-standard frac sand into standard frac sand using at least one jet pump. The present invention also provides a method for removing at least one contaminant from sub-standard frac sand. The standard frac sand according to the various embodiments exhibit desirable frac sand properties such as crush resistance, sphericity, roundness, and turbidity.

In particular, the invention provides a process for producing standard frac sand comprising: (a) passing sub-standard frac sand at least one time through at least one jet pump under processes and conditions sufficient to remove at least one contaminant from the sub-standard frac sand and/or improve sub-standard frac sand into standard frac sand with at least one of the following frac sand properties: (i) clusters of less than 1.0 percent, (ii) at least 90 percent of the standard frac sand should fall between a designated sieve size, (iii) not more than 0.1 percent of the standard frac sand should be larger than a maximum sieve and not more than 1.0 percent of the standard frac sand should fall through a minimum sieve, (iv) a turbidity value of 250 or less, (v) a sphericity value of 0.6 or greater, and (vi) a roundness value of 0.6 or greater; or (b) recovering the standard frac sand and/or the standard frac sand with the desired properties.

In another aspect of the invention, a process for producing standard frac sand is provided comprising: (a) passing sub-standard frac sand at least one time through at least one jet pump under processes and conditions sufficient to remove at least one contaminant from the sub-standard frac sand and/or improve sub-standard frac sand into standard frac sand with all of the following frac sand properties: (i) clusters of less than 1.0 percent, (ii) at least 90 percent of the standard frac sand should fall between a designated sieve size, (iii) not more than 0.1 percent of the standard frac sand should be larger than a maximum sieve and not more than 1.0 percent of the standard frac sand should fall through a minimum sieve, (iv) a turbidity value of 250 or less, (v) a sphericity value of 0.6 or greater, and (vi) a roundness value of 0.6 or greater; and (b) recovering the standard frac sand and/or the standard frac sand with the desired properties.

The sub-standard frac sand may be from any source. Sub-standard frac sand may be found in the water, such as rivers, lake, seas, oceans or the like. The sub-standard frac sand may also be found on the land, within the earth, mines, glaciers or any place known to those skilled in the art. Additionally, the sub-standard frac sand may be sand recovered from fracking sites such as from wells. It is known in the art that different sources of sub-standard frac sand results possess different frac sand properties. For example, river sand has a lower number of frac sand properties than glacier sand. Depending on the source, the sub-standard frac sand may be collected or recovered by any known techniques or apparatus known to those skilled in the art. Non-limiting examples of apparatuses to collect the sub-standard sand include a pump such as a jet pump, vacuum, dredge, bucket, and/or hopper. One skilled in the art can apply any technique to collect the sub-standard frac sand such as dredging. For example, the dredging industry commonly utilizes large centrifugal pumps for suction and movement of slurry material, i.e., water or other liquid in admixture with solid particulate matter, e.g., sub-standard frac sand, gravel, contaminants, and other matters of the like. Another dredging technique involves the use of air to induce an upward flow of water. Other hydraulic pumps employed in dredging and deep sea mining operations employ jet education systems, in which water is forced through piping configurations to cause an upward flow that pulls the water and solid material from the desired location.

In one embodiment of the present invention, a single jet pump is provided configured to collect, move, convey, slurry, scrub, wash, and/or decontaminate the sub-standard sand, contaminant, standard frac sand and/or other solid materials. In another embodiment, at least two jet pumps are configured to collect, move, convey, slurry, scrub, wash, and/or decontaminate the sub-standard sand, contaminant, standard frac sand and/or other solid materials. Non-limiting examples of jet pumps and their various configurations and functions that can be used to improve sub-standard sand in accordance with the present invention are disclosed in U.S. Pat. No. 6,450,775; U.S. Pat. No. 6,322,327 B1; U.S. Pat. No. 6,450,775; U.S. Pat. No. 6,911,145; U.S. Pat. No. 6,817,837; U.S. Ser. No. 10/199,764; U.S. Ser. No. 10/388,780; and U.S. Ser. No. 11/465,928; and their entirety are hereby incorporated by reference. Preferably, the jet pump includes a nozzle assembly that pulls in atmospheric air. A liquid jet created by passage through the nozzle assembly has minimal deflection as it exits because of an atmospheric air bearing surrounding the liquid jet. The jet pump also includes a suction chamber with a suction pipe. The suction pipe pulls in solid material as the liquid jet from the nozzle assembly passes through the suction chamber. The jet pump also includes a target tube that receives the liquid jet combined with materials from the suction pipe through the suction chamber. The target tube includes a housing support detachable from the suction chamber and is composed of a wear plate of abrasion-resistant material. As used herein, "solid material" includes sub-standard frac sand, standard frac sand, contaminants, raw sub-standard frac sand and any other like materials.

In a particularly preferred jet pump, the jet pump comprises: (a) a nozzle assembly which is sized and configured to (i) receive a pressurized liquid and a gas, and (ii) eject said pressurized liquid as a liquid flow while feeding said gas into proximity with the periphery of said liquid flow; (b) a housing defining a suction chamber into which said nozzle assembly may eject said liquid flow, said housing further defining a suction inlet and a suction outlet; (c) an outlet pipe extending from said suction outlet away from said suction chamber, said outlet pipe being configured for fluid communication with said suction chamber and being disposed to receive said liquid flow; said outlet pipe defining at least a first inner diameter along a portion of its length and a second inner diameter along another portion of its length, said second inner diameter being less than said first inner diameter; and (d) a suction pipe, a first end of said suction pipe opening into said suction chamber at said suction inlet, and a second end of said suction pipe opening into the surrounding environment; wherein said nozzle assembly extends into said suction chamber towards said suction outlet and into the imaginary line of flow of said suction pipe.

In another preferred embodiment, the jet pump comprises: (a) a nozzle assembly which is sized and configured to (i) receive a pressurized liquid and a gas, and (ii) eject the pressurized liquid as a liquid flow while feeding the gas into proximity with the periphery of the liquid flow; (b) a housing defining a suction chamber into which the nozzle assembly may eject the liquid flow, the housing further defining a suction inlet and a suction outlet; (c) an inlet pipe for providing pressurized liquid to the nozzle assembly; (d) a gas conduit for providing the gas to the nozzle assembly; (e) an outlet pipe extending from the suction outlet away from the suction chamber, the outlet pipe being configured for liquid communication with the suction chamber and being disposed to receive the liquid flow; the outlet pipe defining at least a first inner diameter along a portion of its length and a second inner diameter along another portion of its length, the second inner diameter being less than the first inner diameter; and (f) a suction pipe, a first end of the suction pipe opening into the suction chamber at the suction inlet, and a second end of the suction pipe opening into the surrounding environment. This invention also provides a system for dredging matter from the bottom of a body of water, the system comprising: (a) a pumping system as described above in this paragraph, (b) a buoyant platform equipped to raise and lower at least a portion of the pumping system relative to the bottom of the body of water, and (c) a first pump for providing the pressurized liquid to the nozzle assembly.

In some cases, the liquid flow mixes with sand to form a slurry which may have a percentage of sand, measured at said outlet pipe, of at least about 30% by weight, or even at least about 40% by weight, or even at least 50% by weight.

In one embodiment, the jet pump may be of any size or configuration. In one embodiment the jet pump may range from about 4 inches to about 18 inches. The nozzle assembly may be of any size and configuration. In one embodiment the nozzle assembly may range from about ½ inch to about 5 inches in diameter. In yet another embodiment, the nozzle assemble may range from about ¾ inch to about 4½ inches in diameter. In yet a further embodiment, the nozzle assembly may range from about 1 inch to about 3 inches in diameter. In another embodiment, the nozzle assemble may range from about 1½ inches to about 2½ inches in diameter. In Preferably, the nozzle assembly of the jet pump is sized from about 2 inches in diameter. The target tube may be of any size and configuration. In one embodiment, the target tube may be from about 2 inches to about 11 inches in diameter. In another embodiment, the target tube may be from about 3 inches to about 9 inches in diameter. In a further embodiment, the target tube is sized from about 4.5 inches to about 6 inches in diameter.

In another embodiment, the target tube is sized and configured with a pressure of at least 20 psi. In another embodiment, the target tube is sized and configured with a pressure of at least 30 psi. In another embodiment, the target tube is sized and configured with a pressure of at least 40 psi. In another embodiment, the target tube is sized and configured with a pressure of at least 50 psi. In another embodiment, the target tube is sized and configured with a pressure of at least 100 psi. In another embodiment, the target tube is sized and configured with a pressure of at least 120 psi. In another embodiment, the target tube is sized and configured with a pressure of at least 130 psi. In another embodiment, the target tube is sized and configured with a pressure of at least 140 psi. In another embodiment, the target tube is sized and configured with a pressure of at least 150 psi. In another embodiment, the target tube is sized and configured with a pressure of at least 160 psi. Without being bound by theory, it is believed that the high pressure within the target tube allows the sub-standard frac sand to swirl in the target tube, usually made of hard materials just as steel, causing it to rub against itself and the harden chamber to reduce nipples and angler grains of the sub-standard frac sand.

In one embodiment, the pressure of the water or fluid through the nozzle assembly may be from about 20 PSI to about 180 PSI. In another embodiment, the pressure of the water or fluid through the nozzle assembly may be from about 60 PSI to about 150 PSI.

In another embodiment, the jet pump is configured to move the sub-standard frac sand at a rate of at least 10 ft/sec. In another embodiment, the jet pump is configured to move the sub-standard frac sand at a rate of at least 20 ft/sec. In another embodiment, the jet pump is configured to move the sub-standard frac sand at a rate of at least 40 ft/sec. In another embodiment, the jet pump is configured to move the sub-standard frac sand at a rate of at least 100 ft/sec. In another embodiment, the jet pump is configured to move the sub-standard frac sand at a rate of at least 120 ft/sec. In another embodiment, the jet pump is configured to move the sub-standard frac sand at a rate of at least 149.5 ft/sec. In a preferred embodiment, the jet pump is configured to change the flow rate of the sub-standard frac sand and the target tube pressure. In a sub-embodiment, the flow rate of and pressure is changed from about 149.5 ft/sec at 150 psi to about 20 ft/sec at 30 psi. Without being bound by theory, it is believed that the sudden change in motion causes the contaminants to release from the sub-standard frac sand.

In one embodiment, at least one first jet pump is configured for receiving raw sub-standard frac sand. "Raw sub-standard frac sand" refers to sub-standard frac sand collected from its source. Raw sub-standard frac sand may also comprise other solid particulate materials such as gravel or the like found in the same area or adjacent to the sub-standard frac sand's source. In a further embodiment, the jet pump is additionally configured to slurry and convey the raw sub-standard frac sand. At least one screen is sized and configured to remove materials that can not be used for standard frac sand from the slurried and conveyed raw sub-standard frac sand, resulting in a first pass sub-standard frac. sand. The screening process can be done at any location known to those skilled in the art, such as a washing plant. A non-limiting example of methods and apparatus used for separating slurried materials is disclosed in U.S. Pat. No. 6,911,145 B2, wherein its entirety is incorporated by reference.

In a further embodiment, at least one second jet pump is configured for receiving the first pass sub-standard frac sand. The second jet pump is additionally configured to wash and scrub the first pass sub-standard frac sand. In a preferred embodiment, the second jet pump moves only sub-standard frac sand to be converted to standard frac sand to the equipment used to dewater the slurry such as a sandscrew, Hydrosizer, and Dewatering screen. In a further embodiment, the resulting standard frac sand and/or standard frac sand with the desired frac sand property is recovered by any known means known in the art.

In another embodiment, the jet pump is configured to remove the contaminant from contaminated sub-standard frac sand to an amount of less than 250 PPM of the contaminant in the decontaminated sub-standard frac sand. In another embodiment, the jet pump is configured to remove the contaminant from contaminated sub-standard frac sand to an amount of less than 100 PPM of the contaminant in the decontaminated sub-standard frac sand.

Standard frac sand must be able to withstand high pressures caused by closing walls of the fractured well and be inexpensive to produce in large quantities. In addition, it is desirable for the frac sand particles to have the ability to form a porous structure for easy flow of liquid through the fracture. One frac sand property that enables the frac sand particles to form a porous structure is the sphericity and roundness of the individual particles. Particles with greater sphericity and roundness tend to form a porous structure. Krumbein Shape Factors have been widely used to determine standard frac sand roundness and sphericity. The standard frac sand grain roundness is a measure of the relative sharpness of grain corners, or of grain curvature. Frac sand sphericity is a measure of how closely a frac sand particle approaches the shape of a sphere. Charts developed by Krumbein and Sloss in 1963 are the most widely used method of determining shape factors. In one embodiment, the roundness frac sand property comprises a Krumbein Shape Factor of at least 0.6. In another embodiment, the sphericity frac sand property comprises a Krumbein Shape Factor of at least 0.6. In a further embodiment, the roundness frac sand property for type 20/40 comprises a Krumbein Shape Factor of at least 0.7. In yet a further embodiment, the sphericity frac sand property for type 40/70 comprises a Krumbein Shape Factor of at least 0.8.

The American Petroleum Industry has established a commonly accepted standard in the industry which requires that the particle sizes be within pre-defined ranges. For example, particle size ranges are defined according to mesh size designations, such as 40/70; 30/50, 20/40, 16/30, 12/20, and 8/16. The first number in the designation refers to the ASTM U.S. Standard mesh size of the largest (top) sieve and the second number refers to the mesh size of the smallest (bottom) sieve. The API standards require that 90% of the spheres comprising the standard frac sand be retained between the top and bottom sieve when sieved through the mesh designations for the product. In one embodiment, a minimum of 90% of the standard frac sand falls between the designated sieve sizes, wherein not over 0.1% of the total standard frac sand sample is larger than the first sieve size and not over 1.0% falls on to the smallest sieve size.

Another important frac sand property is turbidity. Turbidity is a measure to determine the levels of contaminants such as dust, silt, suspended clay, or finely divided inorganic matter levels in standard frac sand. It is a measure of an optical property of a suspension that results from scattering and absorbing of light by the particulate matter present. It is desirable to have a lower turbidity value. Exceeding manufacturer guidelines can have a detrimental effect on the performance of sand used in fracking. Contaminants such as dust can consume oxidative breakers, alter fracturing fluid pH, and/or interfere with crosslinker mechanisms. As a result, higher chemical loadings may be required to control fracturing fluid rheological properties and performance. If fluid rheology is altered, then designed or modeled fracture geometry and conductivity will be altered. A change in conductivity directly correlates to reservoir flow rate. In addition, a lower turbidity value lowers the cost of drying the sand because there are lower amounts of contaminants to dry as well.

In one embodiment, the standard frac sand of the present invention comprises a turbidity value (NTU) of about 250 or less. In a further embodiment, the standard frac sand of the present invention comprises a turbidity value of about 50 or less. In yet a further embodiment, the standard frac sand of the present invention comprises a turbidity value of about 35 or less. In one embodiment, the standard frac sand type 20/40 comprises a turbidity value of about 10 or less. In another embodiment, the standard frac sand type 20/40 comprises a turbidity value of about 5 or less. In another embodiment, the standard frac sand type 40/70 comprises a turbidity value of about 20 or less. In another embodiment, the standard frac sand type 40/70 comprises a turbidity value of about 9 or less.

In another aspect of the present invention, the cluster frac sand property is about 1.0% or less. In yet another embodiment, the cluster frac sand property is about 0.5% or less. In yet another embodiment, the cluster frac sand property is 0.

In another embodiment of the present invention, the ISO crush test frac sand property comprises a value of about 10% or less at 4 lb/ft$^2$ @ 3,000 psi. In another embodiment of the present invention, the ISO crush test frac sand property comprises a value of about 10% or less at 4 lb/ft$^2$ @ 5,000 psi. In yet another embodiment, the ISO crush test frac sand property for type 20/40 comprises a value of about 9% or less at 4 lb/ft$^2$ @ 5,000 psi. In yet another embodiment, the ISO crush test frac sand property for type 20/40 comprises a value of about 8.5% or less at 4 lb/ft$^2$ @ 5,000 psi. In yet another embodiment, the ISO crush test frac sand property for type 20/40 comprises a value of about 15% or less at 4 lb/ft$^2$ @ 6,000 psi. In yet another embodiment, the ISO crush test frac sand property for type 20/40 comprises a value of about 12% or less at 4 lb/ft$^2$ @ 6,000 psi. In yet another embodiment, the ISO crush test frac sand property for type 40/70 comprises a value of about 12% or less at 4 lb/ft$^2$ @ 7,000 psi. In yet another embodiment, the ISO crush test frac sand property for type 40/70 comprises a value of about 9% or less at 4 lb/ft$^2$ @ 7,000 psi. In yet another embodiment, the ISO crush test frac sand property for type 40/70 comprises a value of about 13% or less at 4 lb/ft$^2$ @ 8,000 psi. This test is useful for comparing the frac sand's crush resistance and overall strength under varying stresses. The standard frac sand is exposed to varying stress levels and the amount of fines is calculated and compared to manufacturer specifications. It has been demonstrated that as little as 5% added fines can reduce fracture conductivity by 50%.

The following examples are presented for purposes of illustration, and are not intended to impose limitations on the scope of this invention.

EXAMPLE 1

The treatment of the sub-standard frac sand was carried out under the following conditions: A 8 inch jet pump was used. The jet jump had a 2 inch nozzle assembly and the target tube was 4½ inches. The water pressure through the nozzle was at 150 PSI.

A jet pump was used to slurry and convey the material to a washing plant which screens all the material that can not be used as frac sand from the sub-standard frac sand. The sub-standard frac sand is then washed with another jet pump that has different components in the inside. This second jet pump moves only sand desired to be converted to standard frac sand to the equipment used to dewater the slurry (sandscrew, Hydrosizer, Dewatering screen). This produces material that is cleaner and more suitable for the API testing which is the method that rates the value and marketability of the sands. Our testing shows we are able to keep the contaminants such as silts and clays and other non silica particles from attaching to the silica sand grains. It also removes the particles that are attached to the sand. This keeps the turbidity very low. Ideally glacier sand is preferred, but using river sand with the methods of the present invention achieves the quality and cleanliness for frac purposes. Just after scrubbing (around 45 inches later—maybe a second) with the material moving at 149.5 feet per second and with 150 PSI the material is subject to a reduction in pressure to around 30 PSI and speed to around 20 feet per second. The values of the resulting standard frac sand is shown in Tables 2 and 3.

Figure 2:
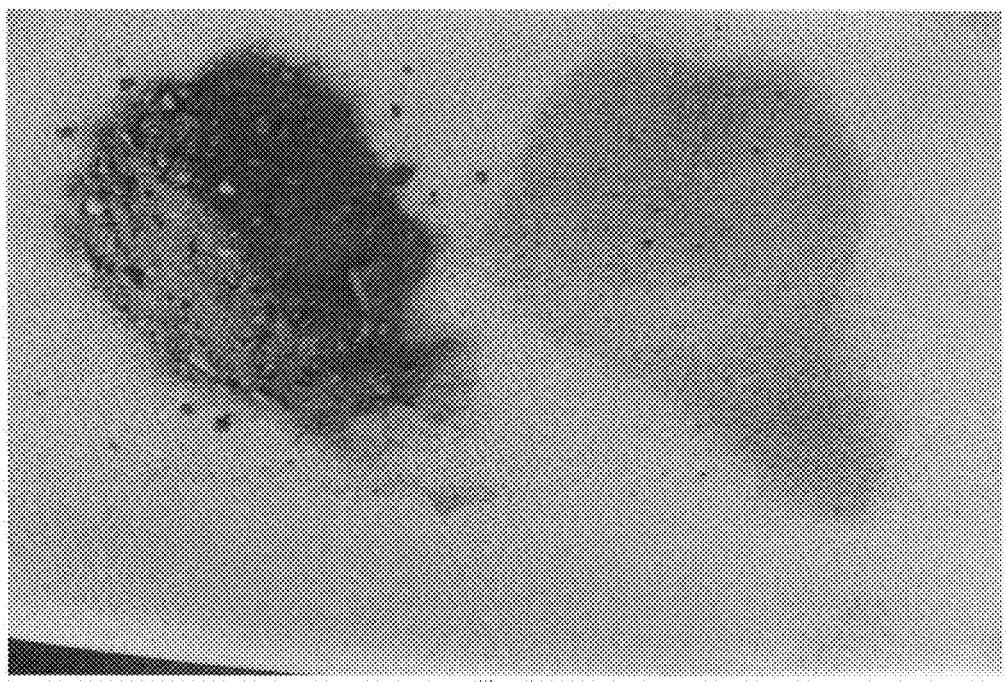
FIG. 2 illustrates shows a decrease in clusters according to one aspect of the invention.

The FIG. 1 shows a comparison of sub-standard frac sand contaminated with 60,000 PPM of oil and with the same sub-standard frac sand after treatment with the jet pump, according to the same conditions mentioned above, comprises less than 100 PPM of oil. FIG. 2 shows regular sand which is mined before being treated with the jet pump, using the same conditions above. Table 1 compares the frac sand property value of sub-standard frac sand that has not been treated with the jet pump according to the present invention. Tables 2 and 3 shows the frac sand property of the sub-standard frac sand that has been improved with the jet pump of the present invention.

TABLE 1

| | | ISO 13503-2 Specifications | 40/70 Frac Sand Published Values | Sub-Standard Frac Sand Sample |
|---|---|---|---|---|
| Turbidity (NTU) | | ≤250 | <50 | 35 |
| Krumbein Shape Factors | | | | |
| Roundness | | ≥0.6 | 0.75 | 0.50 |
| Sphericity | | ≥0.6 | 0.75 | 0.62 |
| Clusters (%) | | ≤1.0 | <1.0 | 0.0 |
| Bulk Density, (g/cm) | | n/a | 1.52 | 1.53 |
| Bulk Density, (lb/ft$^3$) | | n/a | 95.0 | 96.0 |
| Specific Gravity (g/cc) | | n/a | 2.65 | 2.66 |
| Particle Size Distribution, mm | Mesh | | | |
| | 30 | ≤0.1 | 0.0 | 21.4 |
| | 40 | | 4.0 | 21.6 |
| | 45 | | — | 14.6 |
| | 50 | | 43.8 | 14.2 |
| | 60 | | 31.1 | 12.0 |
| | 70 | | 18.4 | 8.6 |
| | 100 | | 2.5 | 5.7 |
| | 140 | | | 1.6 |
| | PAN | ≤0.1 | 0.2 | 0.3 |
| | Total | 100 | 100 | 100 |
| % In Size - 40+70 | | ≥90 | 93.2 | 49.4 |
| Median Particle Diameter, MPD, mm | | n/a | 0.287 | 0.390 |
| ISO Crush Test - 40/70 Sand: 4 lb/ft$^2$ @ 3,000 psi | | ≤10 | n/a | |
| ISO Crush Test - 40/70 Sand: 4 lb/ft$^2$ @ 5,000 psi | | ≤10 | n/a | |
| ISO Crush Test - 40/70 Sand: 4 lb/ft$^2$ @ 6,000 psi | | ≤10 | n/a | |

TABLE 2

| Type 20/40 | | | Type 40/40 | | |
|---|---|---|---|---|---|
| Sieve | % Retained | | Sieve | % Retained | |
| 16 | 0 | Median Particle | 30 | 0 | Median Particle |
| 20 | 1.3 | Size | 40 | 3.6 | Size |
| 25 | 5.1 | 0.549 | 45 | 13.4 | 0.307 |
| 30 | 22.2 | | 50 | 41.9 | |
| 35 | 41.2 | Mean Particle | 60 | 25.7 | Mean Particle |
| 40 | 27.5 | Size | 70 | 12.9 | Size |
| 50 | 2 | 0.562 | 100 | 1.5 | 0.316 |
| Pan | 0 | | Pan | 0 | |
| Total retained - 20 + 40 | 96% | | Total Retained - 40 + 70 | 93.9% | |
| | | 5k Frac Grade Sand | | | 7k Frac Grade Sand |
| ISO Crush Analysis (% fines) @ 5,000 psi | 4 lb/ft$^2$ | 8.30% | ISO Crush Analysis (% fines) @ 7,000 psi | 4 lb/ft$^2$ | 8.80% |
| ISO Crush Analysis (% fines) @ 6,000 psi | 4 lb/ft$^2$ | 11.50% | ISO Crush Analysis (% fines) @ 8,000 psi | 4 lb/ft$^2$ | 12.30% |

TABLE 3

| Physical Properties | | | |
|---|---|---|---|
| Type 20/40 | | Type 40/70 | |
| Turbidity (NTU) | 5 | Turbidity (NTU) | 9 |
| Krumbein Shape Factors | | Krumbein Shape Factors | |
| Roundness | 0.7 | Roundness | 0.7 |
| Sphericity | 0.8 | Sphericity | 0.8 |
| Clusters % | 0 | Clusters % | 0 |
| Bulk Density (g/cc) | 1.52 | Bulk Density (g/cc) | 1.48 |
| Bulk Density (lb/ft3) | 95.1 | Bulk Density (lb/ft3) | 92.5 |
| Solubility in 12/3 HCL/HF | 0.7 | Solubility in 12/3 HCL/HF | 1.3 |
| Specific Gravity (g/cc) | 2.64 | Specific Gravity (g/cc) | 2.61 |

TABLE 3-continued

| Physical Properties | | | | |
|---|---|---|---|---|
| Results of combined EDX and X-Ray Diffraction (XRD) analysis performed on the submitted sample. | | | | |
| SiO2 (Quartz) 96% | Pottasium (K) .19% | Calcium (Ca) .19% | Iron (Fe) .25% | Chlorine (Cl) .1% |
| Aluminum (Al) 2.13% | | Sodium (Na) .24% | | Magnesium (Mg) .17% |

Even though the claims may refer to substances in the present tense (e.g., "comprises", "is", etc.), the reference is to the substance as it exists at the time just before it is first contacted, blended or mixed with one or more other substances in accordance with the present disclosure.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

Each and every patent or other publication or published document referred to in any portion of this specification is incorporated in toto into this disclosure by reference, as if fully set forth herein.

This invention is susceptible to considerable variation within the spirit and scope of the appended claims.

The invention claimed is:

1. A process for producing frac sand comprising:

(a) passing sub-standard frac sand at least one time through at least one jet pump under processes and conditions sufficient to improve sub-standard frac sand into frac sand with at least the following properties: a sphericity value of 0.6 or greater, and a roundness value of 0.6 or greater; and (b) recovering the improved frac sand and/or the frac sand with the desired properties.

2. The process according to claim 1 wherein the passing step further comprises collecting the sub-standard frac sand before passing the sand through the jet pump with at least one hopper or dredge.

3. The process according to claim 1 wherein the sub-standard frac sand is passed at least two times through at least one jet pump.

4. The process according to claim 1 wherein the jet pump comprises:

(a) a nozzle assembly which is sized and configured to (i) receive a pressurized liquid and a gas, and (ii) eject said pressurized liquid as a liquid flow while feeding said gas into proximity with the periphery of said liquid flow;

(b) a housing defining a suction chamber into which said nozzle assembly may eject said liquid flow, said housing further defining a suction inlet and a suction outlet;

(c) an outlet pipe extending from said suction outlet away from said suction chamber, said outlet pipe being configured for fluid communication with said suction chamber and being disposed to receive said liquid flow; said outlet pipe defining at least a first inner diameter along a portion of its length and a second inner diameter along another portion of its length, said second inner diameter being less than said first inner diameter; and (d) a suction pipe, a first end of said suction pipe opening into said suction chamber at said suction inlet, and a second end of said suction pipe opening into the surrounding environment; wherein said nozzle assembly extends into said suction chamber towards said suction outlet and into the imaginary line of flow of said suction pipe.

5. The process according to claim 4 wherein said liquid flow mixes with sand to form a slurry which may have a percentage of sand, measured at said outlet pipe, of at least about 40% by weight.

6. The process according to claim 4 wherein said percentage of solids is at least about 50% by weight.

7. The process of claim 4, wherein the nozzle assembly is sized from at least 2" in diameter and the outlet pipe is sized from at least 4.5" in diameter.

8. The process of claim 4, wherein said liquid flow is configured at least 150 PSI.

9. The process of claim 4, wherein said liquid flow is configured at least 30 PSI.

10. The process of claim 4, wherein said liquid flow is configured at a rate of at least 149.5 ft/sec.

11. The process of claim 4, wherein the liquid flow is configured at a rate of at least 20 ft/sec.

12. The process according to claim 1 wherein the frac sand properties further comprise clusters of less than 1.0 percent, and a turbidity value of 250 or less.

* * * * *